US009756950B2

(12) United States Patent
Choi

(10) Patent No.: US 9,756,950 B2
(45) Date of Patent: Sep. 12, 2017

(54) FOLDING BED

(71) Applicant: Campvalley (Xiamen) Co., Ltd., Xiamen (CN)

(72) Inventor: Kwanjun Choi, KyoungNam (KR)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 14/775,107

(22) PCT Filed: Dec. 18, 2013

(86) PCT No.: PCT/CN2013/089782
§ 371 (c)(1),
(2) Date: Dec. 16, 2015

(87) PCT Pub. No.: WO2014/139299
PCT Pub. Date: Sep. 18, 2014

(65) Prior Publication Data

US 2016/0150889 A1 Jun. 2, 2016

(30) Foreign Application Priority Data

Mar. 14, 2013 (CN) ..... 2013 2 0116055 U

(51) Int. Cl.
*A47C 17/72* (2006.01)
*A47C 19/12* (2006.01)

(52) U.S. Cl.
CPC ..... *A47C 17/72* (2013.01); *A47C 19/126* (2013.01)

(58) Field of Classification Search
CPC ..... A47C 17/64; A47C 17/70; A47C 17/72; A47C 17/74; A47C 17/76; A47C 19/126; A47C 19/14; A61G 1/013
See application file for complete search history.

(56) References Cited

U.S. PATENT DOCUMENTS 893,364 A * 7/1908 Piaser ..... A47C 17/48 5/111
1,263,509 A * 4/1918 Zendt ..... A47C 1/143 297/114

(Continued)

FOREIGN PATENT DOCUMENTS

CN 201067222 Y 6/2008
CN 102599755 A 7/2012

(Continued)

OTHER PUBLICATIONS

International Search report mailed Mar. 6, 2014, for International Patent Application No. PCT/CN2013/089782, 4 pages.

*Primary Examiner* — Eric Kurilla
(74) *Attorney, Agent, or Firm* — Morgan, Lewis & Bockius LLP

(57) ABSTRACT

A folding bed includes a bed frame and a bedding fitted onto the bed frame. The bed frame includes left and right longitudinal poles, vertical poles and groups of slanting poles. Each of the left and right longitudinal poles includes at least three pole pieces sequentially and pivotally connected together at adjacent end portions by unidirectional pivotal connection seats. Adjacent unidirectional pivotal connection seats are disposed facing in opposite directions with respect to each other, allowing the pole pieces to fold upwards or downwards. Upper ends of vertical pole are connected to corresponding unidirectional pivotal connection seats. Each group of slanting poles includes two slanting poles crosswise pivotally connected to each other. Upper ends of slanting poles are pivotally connected to support seats disposed on the pole pieces.

18 Claims, 8 Drawing Sheets

(56) References Cited

U.S. PATENT DOCUMENTS

| | | | | | |
|---|---|---|---|---|---|
| 2,121,100 | A * | 6/1938 | Rosenbaum | A47C 17/17 | 297/244 |
| 2,616,098 | A * | 11/1952 | Love | A47C 17/80 | 5/111 |
| 2,671,229 | A * | 3/1954 | Vernier | A47C 17/68 | 482/28 |
| 3,886,606 | A * | 6/1975 | Bradford | A61G 1/013 | 403/102 |
| 3,918,109 | A * | 11/1975 | Barraclough | A45F 4/06 | 135/90 |
| 3,967,330 | A * | 7/1976 | Zawadowsky | A47C 19/122 | 5/111 |
| 4,034,518 | A * | 7/1977 | Trecker | A45C 9/00 | 190/11 |
| 4,393,529 | A * | 7/1983 | Britz | A61G 5/00 | 297/130 |
| 4,801,176 | A * | 1/1989 | Wolberg | A47C 4/42 | 297/44 |
| 5,023,968 | A * | 6/1991 | Diehl | A61G 1/017 | 403/102 |
| 5,950,259 | A * | 9/1999 | Boggs | A47C 1/143 | 297/900 |
| 6,470,517 | B1 * | 10/2002 | Kang | A47C 17/80 | 5/116 |
| 8,585,135 | B2 * | 11/2013 | Wilson | A47C 1/024 | 297/354.12 |

FOREIGN PATENT DOCUMENTS

| | | | |
|---|---|---|---|
| CN | 203153120 | U | 8/2013 |
| CN | 203153128 | U | 8/2013 |
| JP | 6-197824 | A | 7/1994 |

* cited by examiner

FOLDING BED

This application is U.S. National Phase of International Application No. PCT/CN2012/089782, filed Dec. 18, 2013, which claims priority to Chinese Application No. 201320116055.X, filed Mar. 14, 2013, the disclosures of which are hereby incorporated herein by reference in their entireties for all purposes.

TECHNICAL FIELD

The present invention relates to the field of everyday life, and particularly, to a folding bed applicable to outdoors or camping.

BACKGROUND ART

A structure of an existing folding bed includes a bed frame having a tilt angle and a bed surface fixed on the bed frame. After the bed frame is unfolded, the bed surface is stretched tightly over the surface of the bed frame, thereby forming the folding bed. In a camp bed disclosed by the Chinese Invention Patent No. CN2543429Y, front and rear vertical surfaces of a bed frame thereof are separately formed by a group of slanting poles pivotally connected crosswise; left and right vertical surfaces of the bed frame are separately formed by two groups of slanting poles pivotally connected crosswise; end portions of the slanting poles of the bed frame are pivotally connected to upper and lower foot plates separately; and meanwhile, a vertical pole is further disposed in a matching manner between groups of slanting poles pivotally connected crosswise on the left and right vertical surfaces of the bed frame; in addition, longitudinal poles matching the bed surface are disposed in a matching manner at upper ends of the slanting poles on the left and right vertical surfaces of the bed frame; the left and right longitudinal poles are each formed by pivotally connecting four pole pieces sequentially to upper ends of the slanting poles and the vertical poles. Such a structure can implement convenient folding and unfolding of the bed body.

However, the folding bed of this structure has the following disadvantages:

1. Because the left and right longitudinal poles of the bed frame are each formed by four pole pieces, a pivotal connection part of pole pieces definitely exists in the middle part of the bed body; moreover, because a pivotal connection position of two adjacent pole pieces in the middle part of the bed body is set at the upper foot plate of the slanting pole, when a force is applied on the bed frame, a relatively large torsion is produced at the pivotal connection position in the middle part of the bed body, which easily causes a problem that the pivotal connection position is easy to be fractured, leading to safety hazards in use of the bed frame.

2.

The left and right longitudinal poles of the bed frame are each formed by four pole pieces; therefore, the longitudinal poles have more pivotal connection points, which is also a cause of the unstable support of the bed frame, and further affects use comfort of the bed frame.

SUMMARY OF THE INVENTION

An objective of the present invention is to provide a folding bed with a stable support and a desirable service life.

To achieve the foregoing objective, the present invention uses the following solution:

A folding bed includes a bed frame and a bed surface fitted onto the bed frame; wherein each vertical surface of the bed frame is formed by slanting poles pivotally connected crosswise; longitudinal poles matching the bed surface are disposed in a matching manner at upper ends of pole pieces on left and right vertical surfaces of the bed frame; each longitudinal pole is formed by at least three pole pieces sequentially pivotally connected together; adjacent end portions of the pole pieces are pivotally connected by using unidirectional pivotal connection seats; pole bodies of the pole pieces are pivotally connected to support seats at upper ends of the slanting poles on the left and right vertical surfaces of the bed frame; and meanwhile, adjacent unidirectional pivotal connection seats of the longitudinal poles are disposed in opposite directions, and a vertical pole is disposed in a matching manner on each unidirectional pivotal connection seat enabling the pole pieces to be folded upwards.

A vertical pole is also disposed in a matching manner on each unidirectional pivotal connection seat, of the bed frame, enabling the pole pieces to be folded downwards.

The vertical pole is a telescopic pipe.

The vertical poles separately match with pivotal connection positions of slanting pole groups on the left and right vertical surfaces of the bed frame.

Three groups of the slanting poles pivotally connected crosswise are disposed on the left and right vertical surfaces of the bed frame, and each longitudinal pole is formed by four pole pieces sequentially pivotally connected.

A sleeve seat is disposed at each pivotal connection position of slanting poles pivotally connected crosswise on the left and right vertical surfaces of the bed frame, so that the vertical pole runs through the sleeve seat, to be positioned.

An upward tilt angle is formed at an outer end of the pole piece located in the front of the bed frame.

After the foregoing solution is used, pivotal connection positions of pole pieces of left and right longitudinal poles of the folding bed according to the present invention are implemented by using unidirectional pivotal connection pieces, and a vertical pole is disposed in a matching manner on each unidirectional pivotal connection seat enabling the pole pieces to be folded upwards; therefore, torsion concentration points on the bed frame can be effectively reduced, and the service life of the bed frame is extended. Compared with the existing product, in case that the number of groups of slanting poles pivotally connected crosswise are same, the number of pole pieces forming the longitudinal poles is reduced to some extent, and then the number of pivotal connections of the longitudinal poles is reduced, thereby ensuring the support stability and the use comfort of the bed frame.

DETAILED DESCRIPTION

Figure 1:
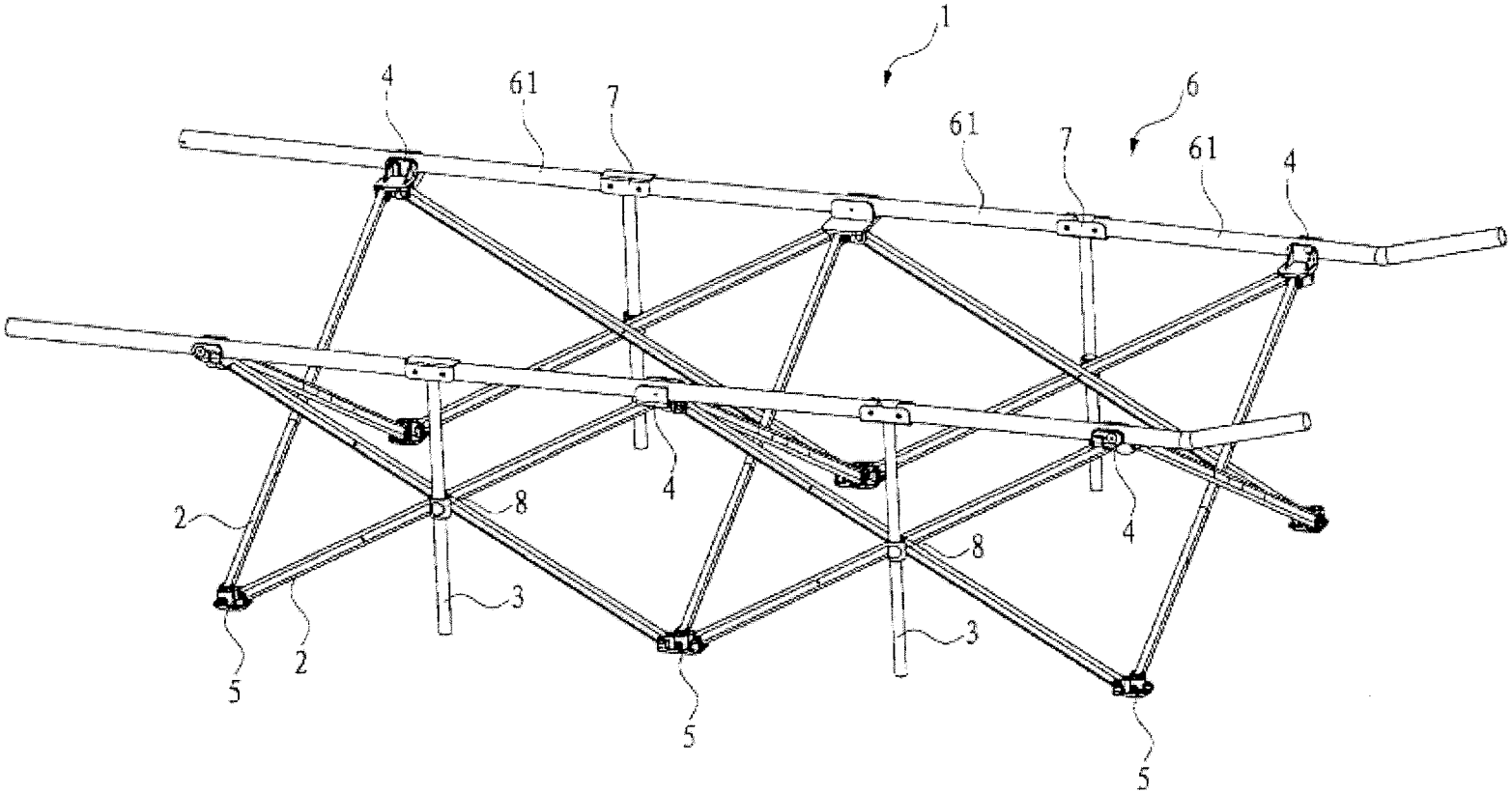
FIG. 1 is a schematic structural view of Example 1 of the present invention.

As shown in FIG. 1 to FIG. 5, the present invention discloses a folding bed, which includes a bed frame 1 and a bed surface (not shown in the figure) fitted onto the bed frame 1, where front and rear vertical surfaces of the bed frame 1 are each formed by one group of slanting poles 2 pivotally connected crosswise, and left and right vertical surfaces of the bed frame 1 are each formed by at least two groups of slanting poles 2 pivotally connected crosswise; end portions of the slanting poles 2 of the bed frame are separately pivotally connected to upper support seats 4 and lower foot plates 5; in addition, longitudinal poles 6 matching the bed surface are disposed at upper ends of pole pieces on the left and right vertical surfaces of the bed frame 1.

The key of the present invention lies in that: each longitudinal pole 6 is formed by at least three pole pieces 61 sequentially pivotally connected together, where adjacent end portions of the pole pieces 61 are pivotally connected by using unidirectional pivotal connection seats 7, and pole bodies of the pole pieces 61 are pivotally connected to the support seats 4 at upper ends of the slanting poles on the left and right vertical surfaces of the bed frame 1; and meanwhile, adjacent unidirectional pivotal connection seats 7 of the longitudinal poles 3 are disposed in opposite directions, where a vertical pole 3 is disposed in a matching manner on each unidirectional pivotal connection seat 7 enabling the pole pieces 61 to be folded upwards, and the vertical pole 3 may be a telescopic pipe.

Figure 2:
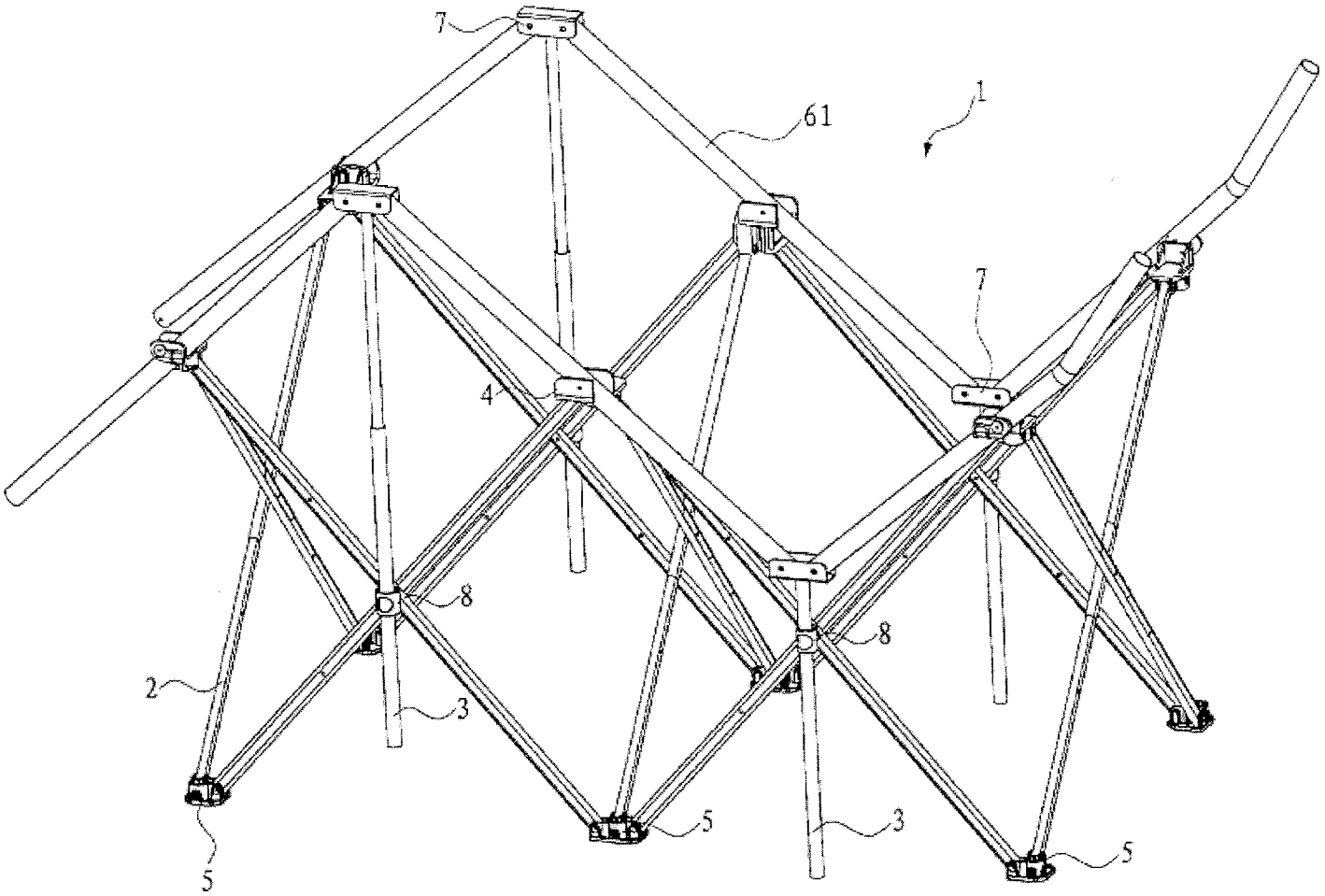
FIG. 2 is a view of a folding action in Example 1 of the present invention.
Figure 3:
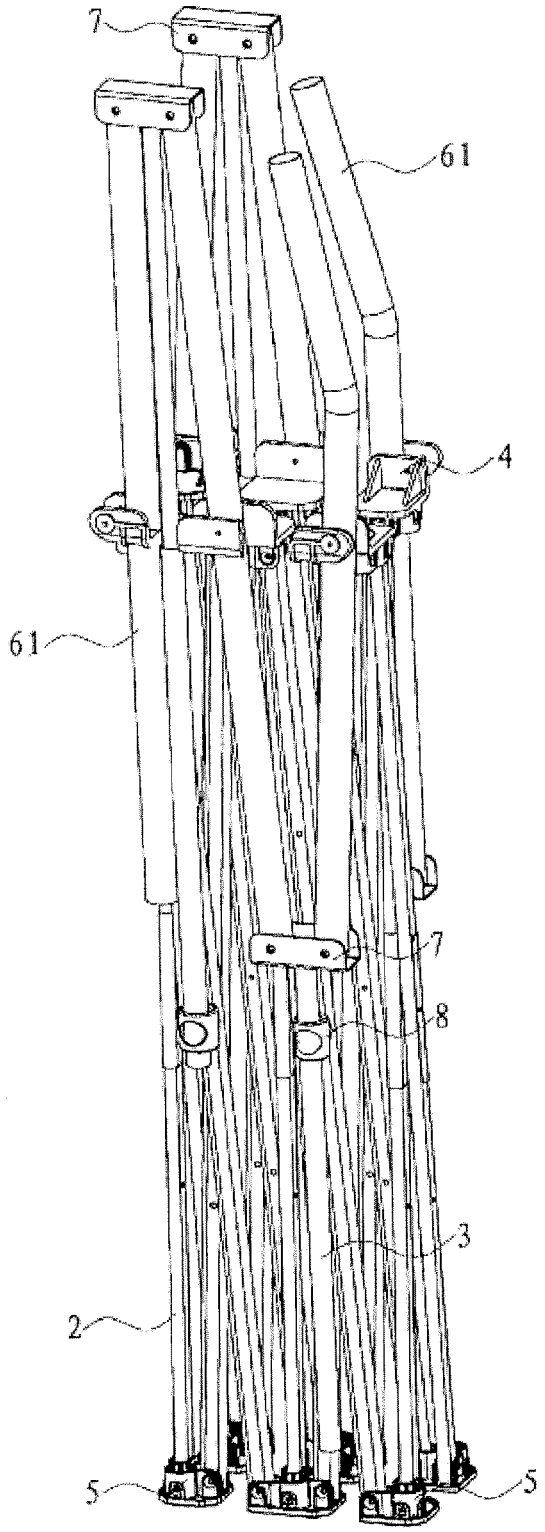
FIG. 3 is a view of a folding state in Example 1 of the present invention.

A first Example of the present invention is shown with reference to FIG. 1 to FIG. 3. In this Example, two groups of slanting poles 2 pivotally connected crosswise are disposed on the left and right vertical surfaces of the bed frame, and meanwhile, a sleeve seat 8 is disposed on each pivotal connection position, so that the vertical pole 3 runs through the sleeve seat, to be positioned. In this Example, each longitudinal pole 6 is formed by three pole pieces 61 sequentially pivotally connected. An upward tilt angle is formed at an outer end of the pole piece 61 located in the front of the bed frame, to enable the bed surface to form a slant leaning surface. The vertical pole 3 in the rear of the bed frame is a telescopic sleeve pipe, and the unidirectional pivotal connection seat 7 at the upper end thereof enables two pivotally connected pole pieces 61 to be folded downwards relative to the bed surface. The vertical pole 3, which is the telescopic pipe, can satisfy a change in the length of the bed frame during folding, and in this case, the unidirectional pivotal connection seat 7 at the upper end of the vertical pole 3 located in the front of the bed frame enables two pivotally connected pole pieces 61 to be folded upwards relative to the bed surface.

In the bed frame formed in this manner, the pole body of the pole piece 61 is just located at the middle part of the bed body that bears a relatively large force, and the whole pole piece 61 can ensure strength of the middle part of the bed body during bearing a force. Moreover, compared with the existing product, in case that the number of groups of slanting poles pivotally connected crosswise are same, the number of pole pieces 61 forming the longitudinal poles 6 is reduced to some extent, thereby reducing the number of pivotal connections of the longitudinal poles 6. Therefore, the support stability and the use comfort of the bed frame is ensured. Pivotal connection positions of adjacent pole pieces 61 are disposed at upper ends of the vertical poles 3, which reduces the occurrence of torsion concentration points on the bed frame, and effectively improves the service life of the bed frame.

Figure 4:
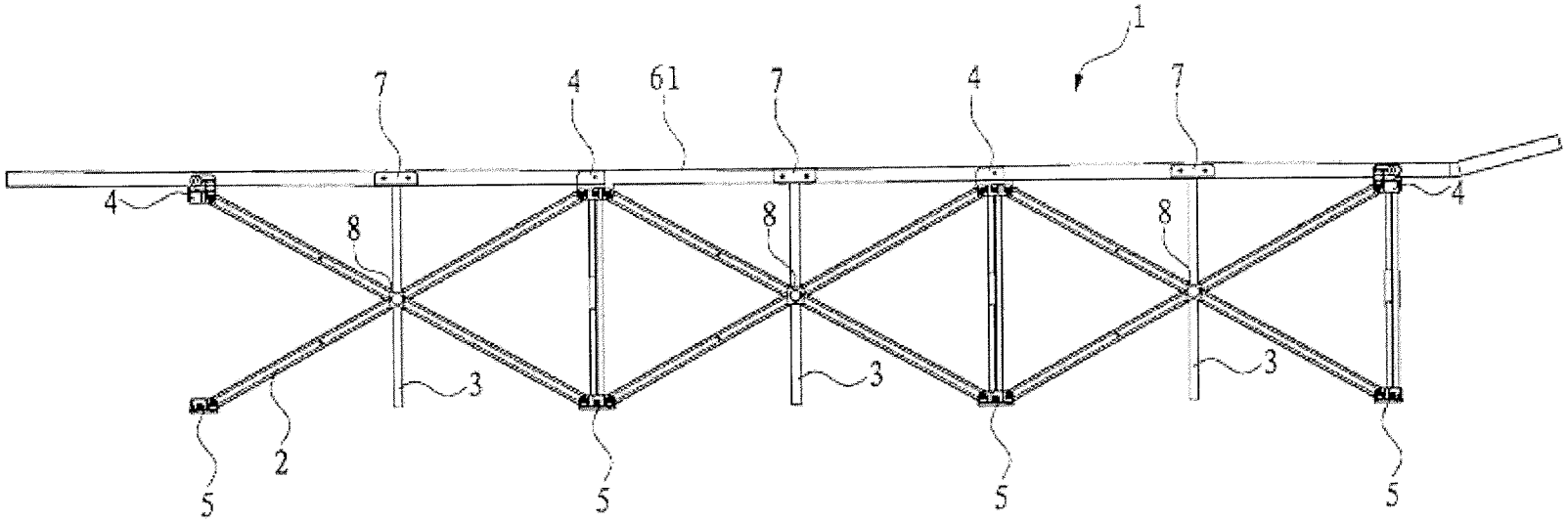
FIG. 4 is a side structural view of Example 2 of the present invention.
Figure 5:
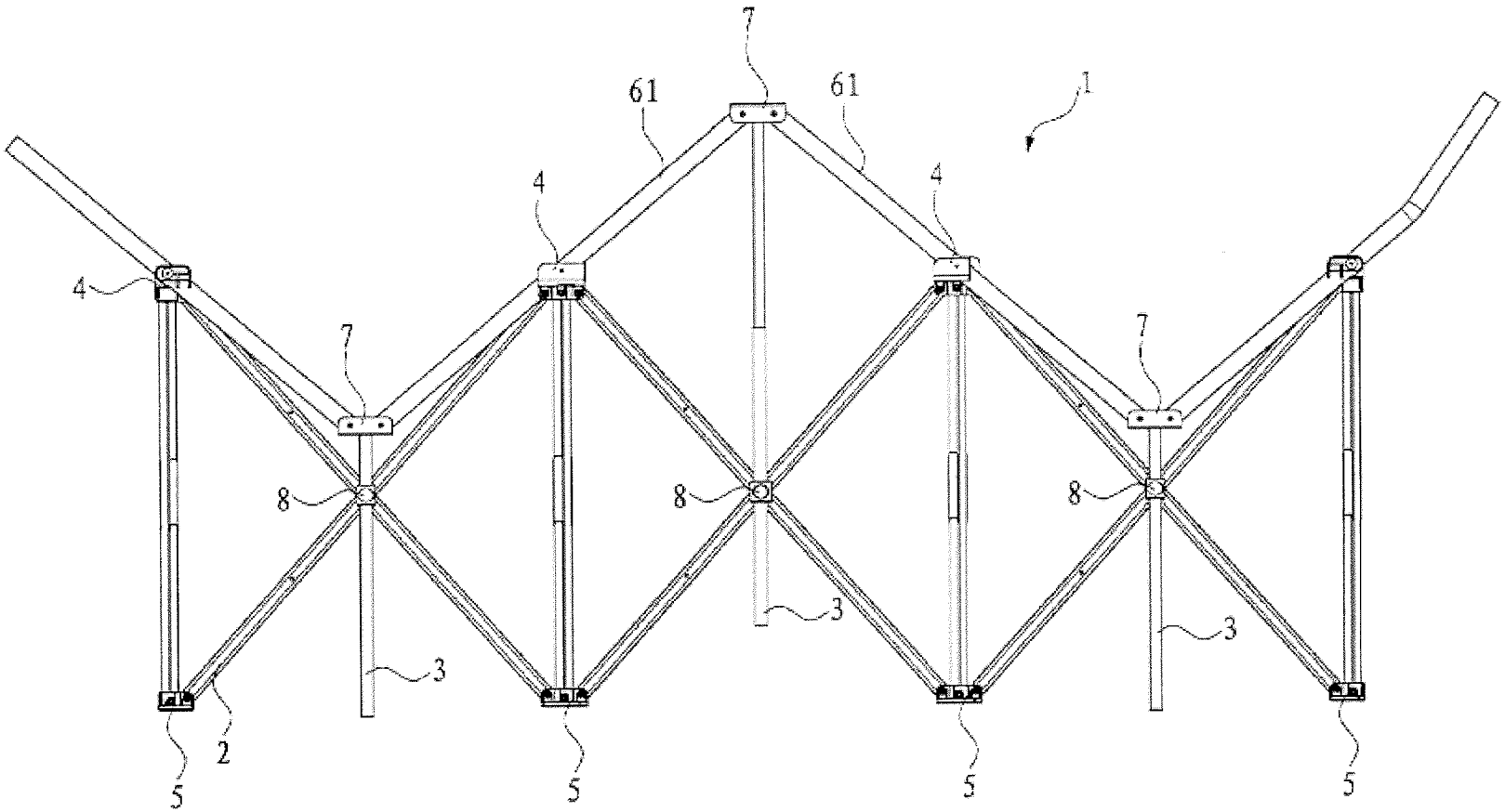
FIG. 5 is a side view of a folding action in Example 2 of the present invention.

Further, a second Example of the present invention is shown with reference to FIG. 4 and FIG. 5. In this Example, three groups of the slanting poles 2 pivotally connected crosswise are disposed on the left and right vertical surfaces of the bed frame, and therefore, the support stability of the bed frame is relatively improved; meanwhile, a sleeve seat 8 is disposed at each pivot connection position, so that the vertical pole 3 runs through the sleeve seat 8, to be positioned. In this Example, each longitudinal pole 6 is formed by four pole pieces 61 sequentially pivotally connected. An upward tilt angle is formed at an outer end of the pole piece 61 located in the front of the bed frame, to enable the bed surface to form a slant leaning surface. The vertical pole 3 in the middle part of the bed frame is a telescopic pipe, and the unidirectional pivotal connection seat 7 at an upper end thereof enables two pivotally connected pole pieces 61 to be folded downwards relative to the bed surface. The vertical pole 3, which is the telescopic pipe, can satisfy a change in the length of the bed frame during folding, and in this case, the unidirectional pivotal connection seats 7 at the upper ends of the vertical poles 3 located in the front and rear of the bed frame enable two pivotally connected pole pieces 61 to be folded upwards relative to the bed surface.

In the bed frame formed in this manner, although a pivotal connection position of two pole pieces 6 is located at the middle part of the bed body that bears a relatively large force, the possibility of generating a torsion is reduced to some extent because the number of groups of slanting poles 2 pivotally connected crosswise is increased and pivotal connection positions of the pole pieces 6 are all supported by the vertical poles 3. Therefore, the support stability and the use comfort of the bed frame can also be ensured, the occurrence of torsion concentration points on the bed frame can be reduced, and the service life of the bed frame can be effectively improved.

Figure 6:
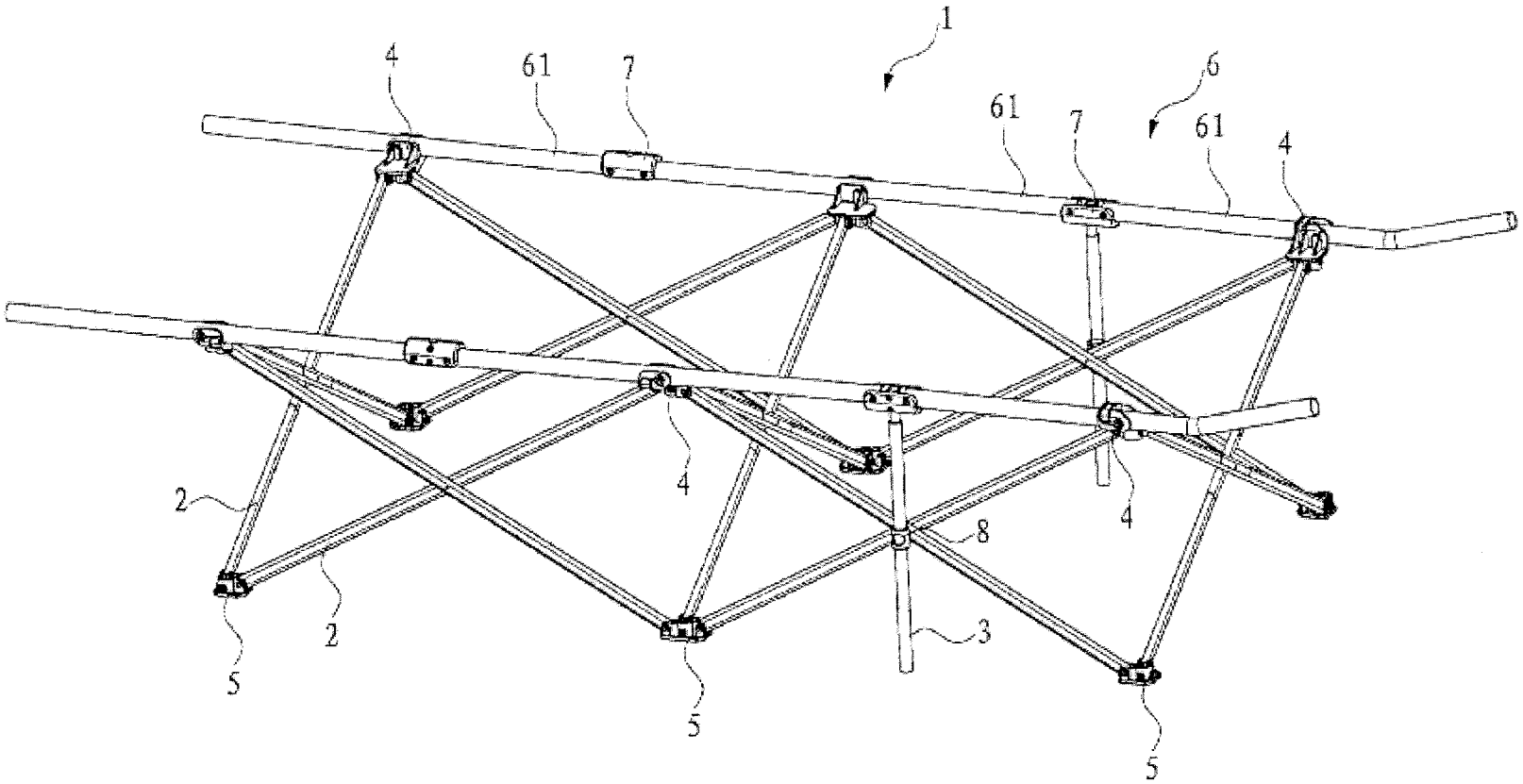
FIG. 6 is a schematic structural view of Example 3 of the present invention.
Figure 7:
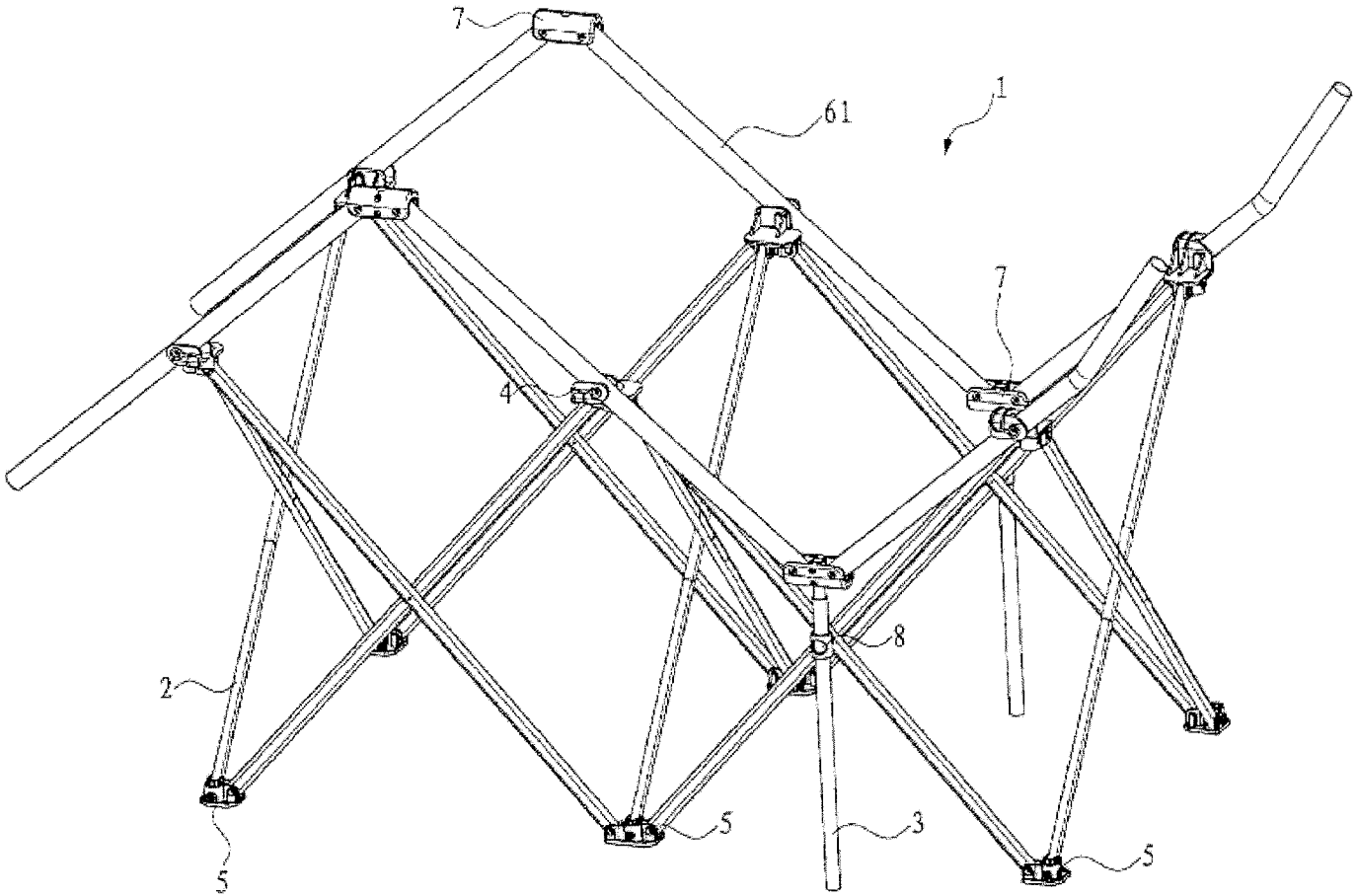
FIG. 7 is a view of a folding action in Example 3 of the present invention.
Figure 8:
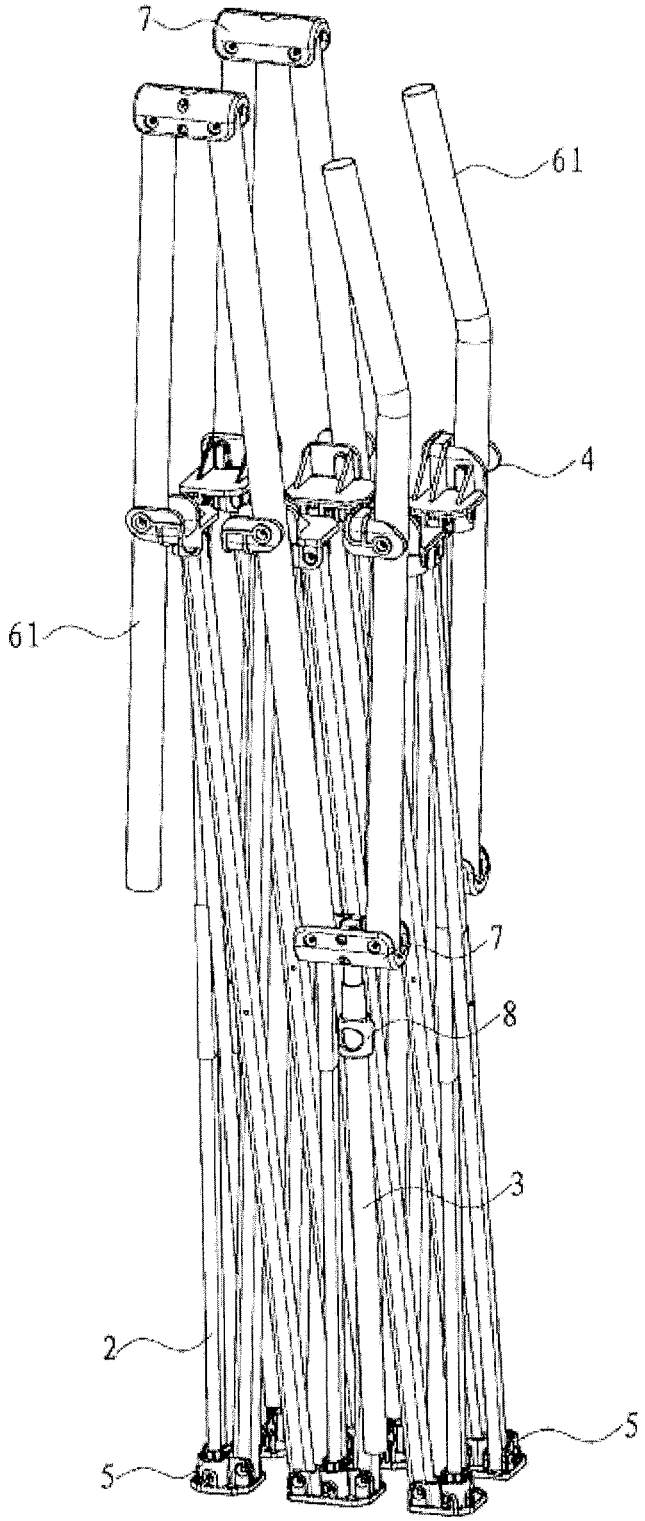
FIG. 8 is a view of a folding state in Example 3 of the present invention.

Further, in a third Example of the present invention shown with reference to FIG. 6 to FIG. 8, two groups of slanting poles 2 pivotally connected crosswise are disposed on the left and right vertical surfaces of the bed frame, and the difference thereof between the first Example lies in that, the foregoing function can also be implemented without disposing a vertical pole 3 at each unidirectional pivotal connection seat 7 enabling the pole pieces 61 to be folded downwards.

The invention claimed is:

1. A folding bed, comprising:

a bed frame foldable from an unfolded configuration to a folded configuration and vice versa, the bed frame comprising:

a left longitudinal pole and a right longitudinal pole, each of the left and right longitudinal poles comprising at least three pole pieces sequentially and pivotally connected together at adjacent end portions of the pole pieces by unidirectional pivotal connection seats, wherein adjacent unidirectional pivotal connection seats are disposed facing in opposite directions with respect to each other, thereby allowing the pole pieces to fold upwards or downwards;

a plurality of vertical poles for supporting the left and right longitudinal poles when the folding bed is unfolded, wherein an upper end of each respective vertical pole is connected to one of the unidirectional pivotal connection seats; and a plurality of support seats, each having a longitudinal axis and each disposed on a pole body of one of the pole pieces; and a plurality of groups of slanting poles, wherein each group of slanting poles comprises two slanting poles crosswise pivotally connected to each other, and an upper end of each respective slanting pole is pivotally connected to one of the support seats; and a plurality of sleeve seats, wherein a sleeve seat in the plurality of the sleeve seats is disposed at a pivotal connection position of each respective group of the slanting poles on a left or a right of the bed frame, and one of the vertical poles runs through one of the sleeve seats; and a bedding fitted onto the bed frame;

wherein the longitudinal axis of each support seat is maintained in a substantially horizontal orientation when moving from the unfolded configuration to the folded configuration.

2. The folding bed of claim 1, wherein at least one of the vertical poles is a telescope pipe.

3. The folding bed of claim 1, wherein:

each of the left and right longitudinal poles comprises four pole pieces sequentially pivotally connected together; and the plurality of groups of slanting poles comprises three groups of the slanting poles disposed on a left of the bed frame and also comprises three groups of the slanting poles disposed on a right of the bed frame.

4. The folding bed of claim 1, wherein an outer end of one of the pole pieces in each of the left and right longitudinal poles is located in a front of the bed frame and is tilted upward when the bed frame is unfolded.

5. A folding bed, comprising:

a bed frame foldable from an unfolded configuration to a folded configuration and vice versa, the bed frame comprising:

a left longitudinal pole and a right longitudinal pole, each of the left and right longitudinal poles comprising at least three pole pieces sequentially and pivotally connected together at adjacent end portions of the pole pieces by unidirectional pivotal connection seats, wherein adjacent unidirectional pivotal connection seats are disposed facing in opposite directions with respect to each other, thereby allowing the pole pieces to fold upwards or downwards;

a plurality of vertical poles for supporting the left and right longitudinal poles when the folding bed is unfolded, wherein an upper end of each respective vertical pole is connected to one of the unidirectional pivotal connection seats;

a plurality of support seats, each having a longitudinal axis and each pivotally connected to a pole body of one of the pole pieces; and a plurality of groups of slanting poles, wherein each group of slanting poles comprises two slanting poles crosswise pivotally connected to each other at middle portions of the two slanting poles, and an upper end of each respective slanting pole is pivotally connected to one of the support seats; and a bedding fitted onto the bed frame;

wherein the longitudinal axis of each support seat is maintained in a substantially horizontal orientation when moving from the unfolded configuration to the folded configuration.

6. The folding bed according to claim 5, wherein at least one of the vertical poles is a telescope pipe.

7. The folding bed according to claim 5, wherein the plurality of groups of slanting poles comprises three groups of the slanting poles disposed on each of a left and a right of the bed frame, and each longitudinal pole is formed by four pole pieces sequentially pivotally connected.

8. The folding bed according to claim 5, wherein an outer end of one of the pole pieces in each of the left and right longitudinal poles is located in a front of the bed frame and is tilted upward when the bed frame is unfolded.

9. The folding bed of claim 5, wherein the bed frame further comprises a plurality of foot plates, wherein a lower end of each slanting pole is pivotally connected to one of the foot plates.

10. A bed frame for a folding bed being foldable from an unfolded configuration to a folded configuration and vice versa, the bed frame comprising:

a left longitudinal pole and a right longitudinal pole, each of the left and right longitudinal poles comprising at least three pole pieces sequentially and pivotally connected together at adjacent end portions of the pole pieces by unidirectional pivotal connection seats, wherein adjacent unidirectional pivotal connection seats are disposed facing in opposite directions with respect to each other, thereby allowing the pole pieces to fold upwards or downwards;

a plurality of vertical poles for supporting the left and right longitudinal poles when the folding bed is unfolded, wherein an upper end of each respective vertical pole is connected to one of the unidirectional pivotal connection seats;

a plurality of support seats, each having a longitudinal axis and each pivotally connected to a pole body of one of the pole pieces; and a plurality of groups of slanting poles, wherein each group of slanting poles comprises two slanting poles crosswise pivotally connected to each other at middle portions of the two slanting poles, and an upper end of each respective slanting pole is pivotally connected to one of the support seats;

wherein the longitudinal axis of each support seat is maintained in a substantially horizontal orientation when moving from the unfolded configuration to the folded configuration.

11. The bed frame of claim 10, wherein at least one of the vertical poles is a telescope pipe.

12. The bed frame of claim 10, wherein:

each of the left and right longitudinal poles comprises four pole pieces sequentially pivotally connected together; and the plurality of the groups of the slanting poles comprises three groups of the slanting poles disposed on a left of the bed frame and comprises three groups of the slanting poles disposed on a right of the bed frame.

13. The bed frame of claim 10, wherein an outer end of one of the pole pieces in each of the left and right longitudinal poles is located in a front of the bed frame and is tilted upward when the bed frame is unfolded.

14. The bed frame of claim 10, further comprising: a plurality of foot plates, wherein a lower end of each slanting pole is pivotally connected to one of the foot plates.

15. A bed frame for a folding bed being foldable from an unfolded configuration to a folded configuration and vice versa, the bed frame comprising:

a left longitudinal pole and a right longitudinal pole, each of the left and right longitudinal poles comprising at least three pole pieces sequentially and pivotally connected together at adjacent end portions of the pole pieces by unidirectional pivotal connection seats, wherein adjacent unidirectional pivotal connection seats are disposed facing in opposite directions with respect to each other, thereby allowing the pole pieces to fold upwards or downwards;

a plurality of vertical poles for supporting the left and right longitudinal poles when the folding bed is unfolded, wherein an upper end of each respective vertical pole is connected to one of the unidirectional pivotal connection seats;

a plurality of support seats, each having a longitudinal axis and each disposed on a pole body of one of the pole pieces; and a plurality of groups of slanting poles, wherein each group of slanting poles comprises two slanting poles crosswise pivotally connected to each other, and an upper end of each respective slanting pole is pivotally connected to one of the support seats; and a plurality of sleeve seats, wherein each sleeve seat in the plurality of the sleeve seats is disposed at a pivotal connection position of each respective group of the slanting poles on a left or a right of the bed frame, and one of the vertical poles runs through one of the sleeve seats;

wherein the longitudinal axis of each support seat is maintained in a substantially horizontal orientation when moving from the unfolded configuration to the folded configuration.

16. The bed frame of claim 15, wherein at least one of the vertical poles is a telescope pipe.

17. The bed frame of claim 15, wherein:

each of the left and right longitudinal poles comprises four pole pieces sequentially pivotally connected together; and the plurality of groups of slanting poles comprises three groups of the slanting poles disposed on a left of the bed frame and also comprises three groups of the slanting poles disposed on a right of the bed frame.

18. The bed frame of claim 15, wherein an outer end of one of the pole pieces in each of the left and right longitudinal poles is located in a front of the bed frame and is tilted upward when the bed frame is unfolded.

* * * * *